United States Patent [19]

Nist et al.

[11] Patent Number: 4,941,546

[45] Date of Patent: Jul. 17, 1990

[54] AERIAL LADDER ROTATION LIMITER

[75] Inventors: Thomas R. Nist, Princeton, W. Va.; Edward V. Garnett, Huntington Beach, Calif.

[73] Assignee: Figgie International Inc., Willoughby, Ohio

[21] Appl. No.: 307,898

[22] Filed: Feb. 7, 1989

[51] Int. Cl.[5] ..... E06C 5/00

[52] U.S. Cl. ..... 182/17; 182/65; 212/189

[58] Field of Search ..... 182/17, 65–68; 212/189

[56] References Cited

U.S. PATENT DOCUMENTS

| | | | |
|---|---|---|---|
| 835,153 | 11/1906 | Cooper | 182/67 |
| 1,155,958 | 10/1915 | Richard | 182/17 |
| 1,761,726 | 6/1930 | Havens | 182/65 |
| 3,253,717 | 5/1966 | Krynytzky . | |
| 3,584,703 | 6/1971 | Lane | 182/67 |
| 4,059,170 | 11/1977 | Young . | |
| 4,382,631 | 5/1983 | Johnson . | |
| 4,383,617 | 5/1983 | Hychalk . | |

OTHER PUBLICATIONS

Agreement including specification for construction bids for fire truck, published Aug. 1987 by Woodbridge N.J. Fire Dept., see p. 69 of 74.

*Primary Examiner*—Reinaldo P. Machado
*Attorney, Agent, or Firm*—Jones, Day, Reavis & Pogue

[57] ABSTRACT

A fire truck includes an aerial ladder mounted on a rotatable base and outriggers on each side of the truck to stabilize the ladder in use. The outriggers may be deployed on only one side of the vehicle to permit use in confined areas. The ladder base is interlocked with the outriggers to permit the ladder to be positioned only on the side of the fire truck stabilized by the deployed outriggers. A retractable pin is connected through a mechanical linkage to each outrigger. Stop blocks mounted on opposite sides of the rotatable base contact any extended pins. Rotation of the base is thereby confined to a sector where the pins have been retracted by deployment of the associated outriggers. Small auxiliary jacks on each side of the fire truck are deployed in response to deployment of the outriggers on the opposite side of the truck. The jacks provide stability when the aerial ladder is used as a water tower for supporting a high pressure hose.

17 Claims, 8 Drawing Sheets

AERIAL LADDER ROTATION LIMITER

BACKGROUND OF THE INVENTION

This invention relates to vertically extendible platforms mounted on vehicles, such as an aerial ladder mounted on a fire truck. More particularly, the invention relates to an arrangement for preserving safety in the operation of an aerial ladder or the like while permitting its use in previously inaccessible areas.

Many safety and maintenance vehicles are equipped with vertically extendible devices to permit operation high above the ground. An example is an aerial ladder carried by a fire truck. These vertically extendible devices must be carefully supported and stabilized for the safety of persons using them. An aerial ladder on a fire truck, for example, is typically mounted on a rotatable base or platform which permits the ladder to be positioned at any point on a circular arc. The fire truck and ladder are stabilized by outriggers deployed outwardly on opposite sides of the truck. Such outriggers usually extend about five feet on each side of the fire truck and provide very good stabilization for any rotational position of the aerial ladder.

A disadvantage in the use of such outriggers, however, is the width or area they require when deployed. Narrow streets and alleys in many communities can inhibit the use of the longer aerial ladders because of the width required to deploy the supporting outriggers. Even in wider streets, the area required for the outriggers reduces flexibility in the choice of positions for the fire truck. Despite the disadvantage in their use, outriggers are required for safe operation on the extended aerial ladders.

SUMMARY OF THE INVENTION

The present invention substantially overcomes the disadvantage described above by significantly reducing the width or area required for the outriggers while preserving safety in operation. According to the present invention, an outrigger may be deployed on only one side of the vehicle and positions of the ladder are confined to the side of the fire truck where the outrigger is deployed. Operational safety is preserved because the ladder is limited to operation on the stabilized side of the fire truck. At the same time, the fire truck can operate with more flexibility and in locations previously impossible or impractical.

Apparatus improved according to the present invention includes a rotatable base or platform and a vertically extendible device such as a ladder mounted on the base. A stabilizer such as an outrigger is provided for stabilizing the vertically extendible device within a predetermined circumferential sector. Means is provided which, in response to deployment of a stabilizer, permits positioning of the vertically extendible device only within the predetermined sector in which it is supported by the stabilizer.

Preferably, a mechanical means such as a retractable pin is placed in the rotation path of the base. The pin is retracted by a mechanical linkage in response to deployment of the stabilizer. The retraction permits rotation of the base to position the ladder or other device within the predetermined sector occupied by the deployed stabilizer.

Apparatus according to the present invention may also include a small auxilliary stabilizer which is deployed automatically in response to deployment of a stabilizer on the opposite side of the rotatable base. The auxilliary stabilizer provides support for resisting reaction forces developed by a high pressure hose operated near the top of an extended aerial device.

DESCRIPTION OF A PREFERRED EMBODIMENT

Figure 1:
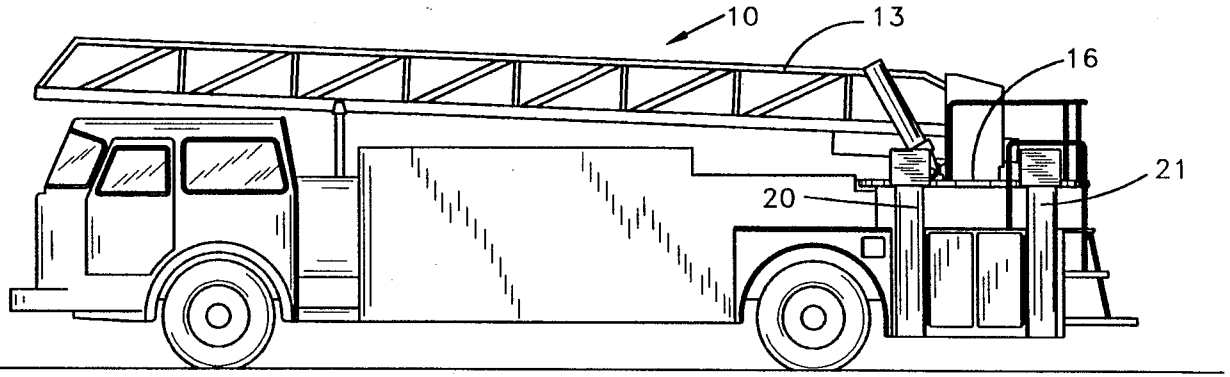
FIG. 1 is a side elevational view of a vehicle embodying the present invention.
Figure 2:
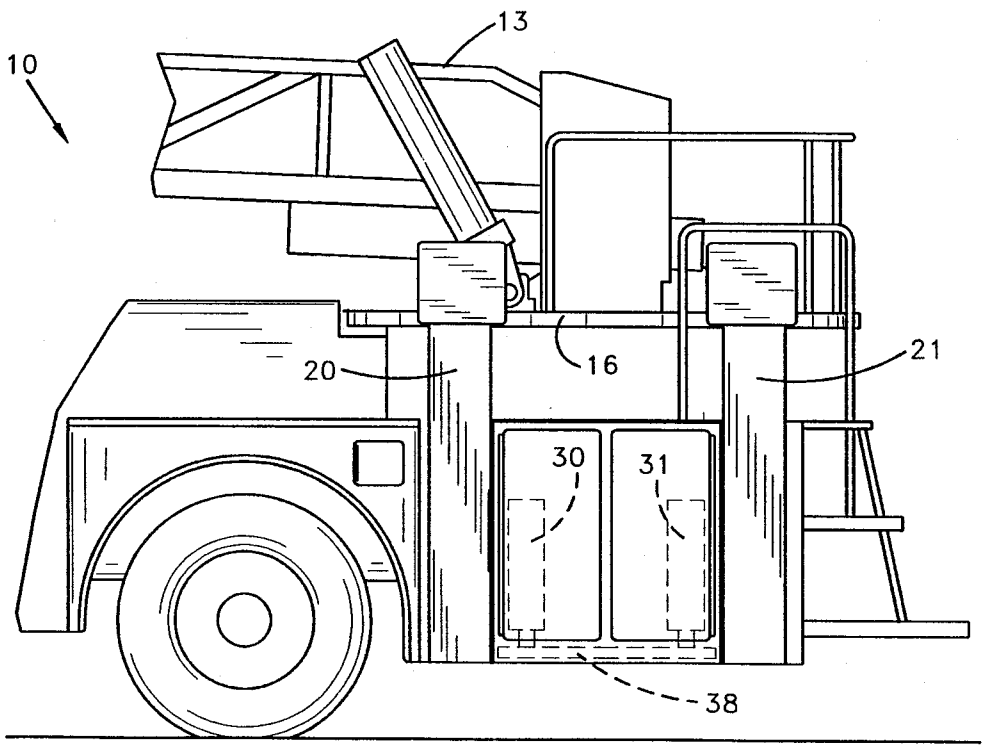
FIG. 2 is a side elevational view of the rear portion of the vehicle of FIG. 1 to a larger scale.
Figure 3:
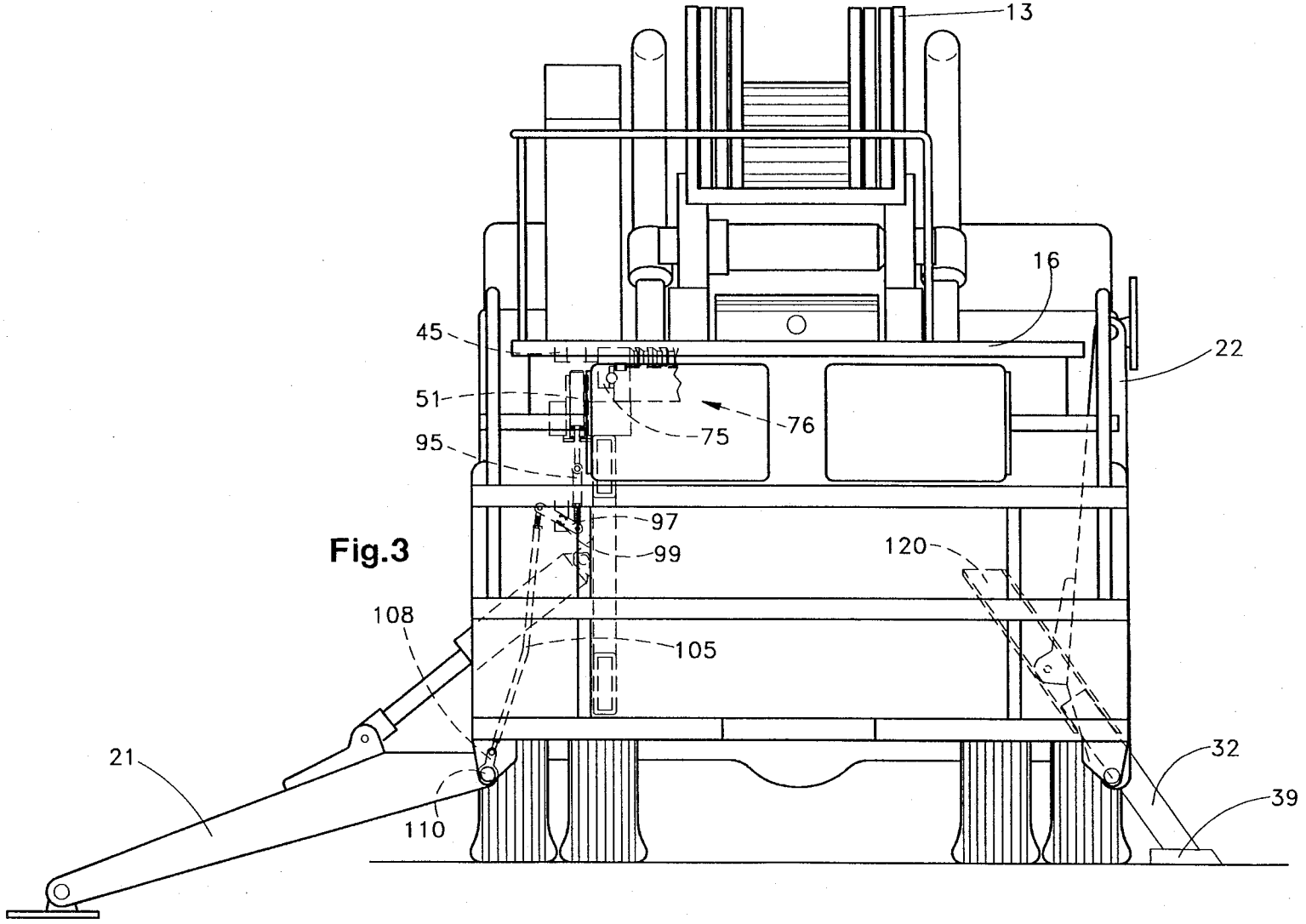
FIG. 3 is a rear elevational view of the vehicle of FIGS. 1 and 2.

Referring initially to FIGS. 1–3, there is shown a fire truck 10 equipped with an aerial ladder 13 mounted on a rotatable base 16 near the rear of truck 10. Ladder 13 can be elevated by hydraulic cylinders in a known manner and, by rotating base 16, positioned at any point in a circular path to provide access for fire fighters to the upper portions of a burning building or other emergency situation. When ladder 13 is extended to a position high above the ground, its stability must be insured for the safety of persons using it. For this purpose, fire truck 10 is equipped with stabilizing outriggers. Four outriggers 20–23 are shown, two on each side of fire truck 10. However, in other embodiments only one outrigger of suitable size and strength nay be provided on each side of the fire truck. Outriggers 20–23 are normally carried in a retracted upright position on the sides of fire truck 10 adjacent rotatable base 16. When ladder 13 is elevated the outriggers have typically been extended on both sides of fire truck 10 to stabilize the ladder in any position on either side of the truck.

While outriggers 20–23 are effective in stabilizing ladder 13, they also substantially increase the area required for placement of fire truck 10. This requirement can be a substantial disadvantage in narrow streets or congested areas. According to the present invention, it has been recognized that the area or width required can be substantially reduced without impairing the safety of persons on ladder 13. The outriggers are deployed on only one side of fire truck 10 and the rotational position of ladder 13 is limited to the side of the vehicle on which the outriggers are deployed. Thus, in FIG. 3 outrigger 20 (not shown) and outrigger 21 on the left side of truck 10 are deployed while outrigger 22 and outrigger 23 (not shown) are retracted.

As shown in FIGS. 2 and 3, fire truck 10 is also provided with smaller auxilliary jacks 30–33. Auxilliary jacks 30, 31 on the left side of the truck share a common stabilizing foot 38 while jack 32 and jack 33 (not shown)

on the right side share foot 39. Aerial ladder 13 is also used as a base for a high velocity hose which can develop a substantial reaction force. The auxilliary jacks are provided to stabilize ladder 13 against this reaction force. The jacks are deployed only on the side opposite that on which the outriggers are deployed and automatically in response to outrigger deployoment.

Referring now to FIGS. 4 to 8, the rotational position of ladder 13 is limited by contact between stop blocks 45 and 46 mounted on opposite sides of rotatable base 16 and retractable pins 50, 51 and 53, 54. Pins 50, 51 are mounted on one side of truck 10 adjacent stop block 45 as shown and pins 53, 54 on the opposite side adjacent block 46. Each pin 50, 51 and 53, 54 is linked to an associated outrigger. Pins 50 and 51 are associated with outriggers 20 and 21, respectively, and pin 52, 53 with outriggers 22, 23 respectively. The extended or retracted position of each pin 50–53 is determined by the retracted or deployed position of its associated outrigger 20–23.

Figure 5:
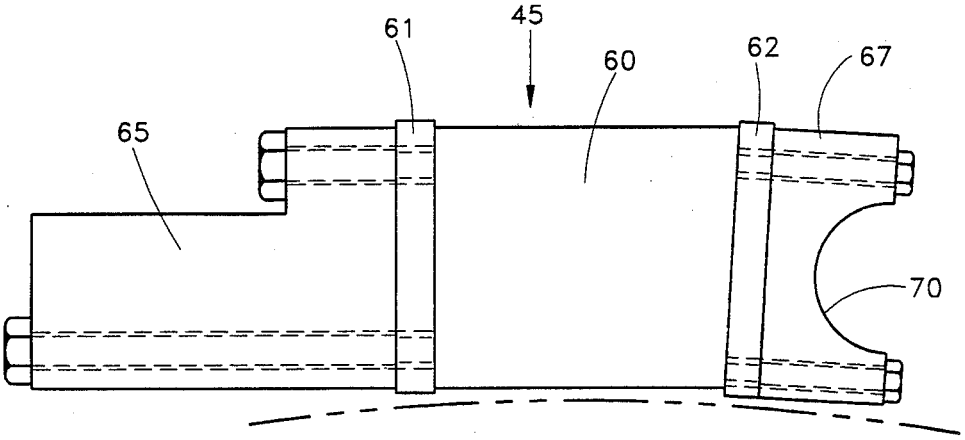
FIG. 5 is a top elevational view of a stop block.
Figure 7:
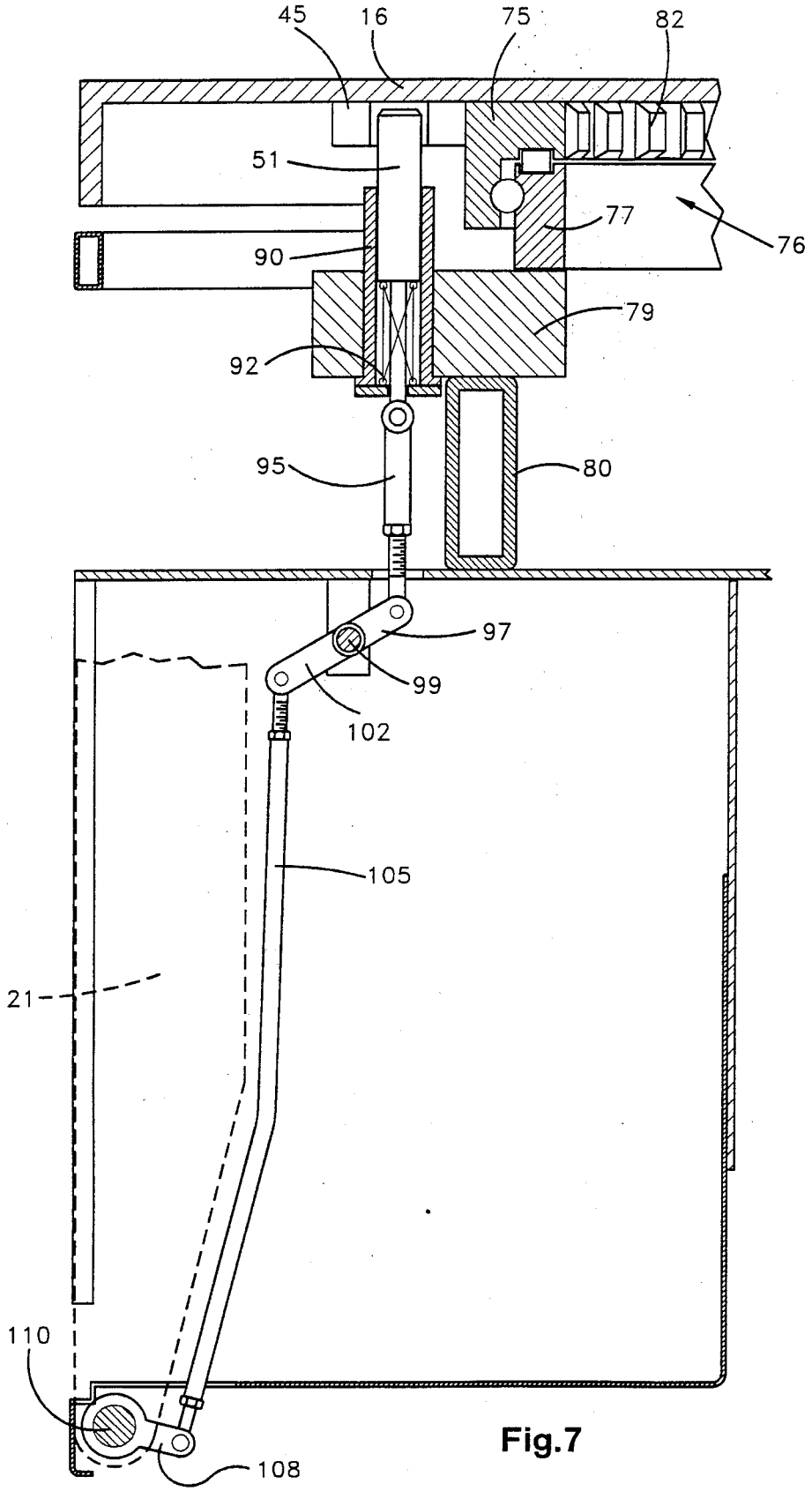
FIG. 7 is a view in the direction of the arrows 7—7 of FIG. 6.
Figure 8:
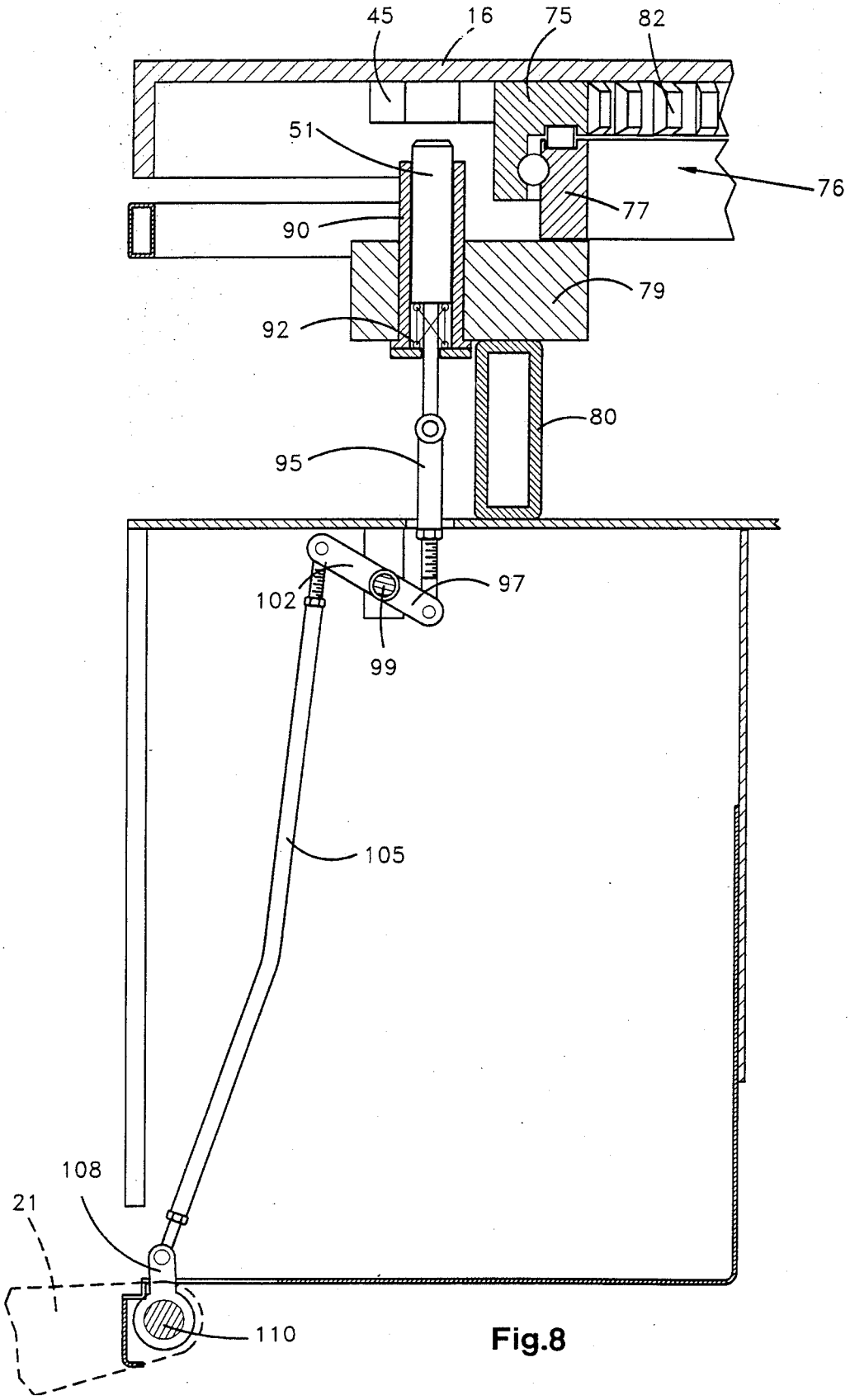
FIG. 8 is a view similar to FIG. 7 but with the outrigger in the deployed position.

Each stop block 45, 46 is welded to the underside of rotatable base 16 as shown for block 45 in FIGS. 7 and 8. As shown in FIG. 5, each stop block (only block 45 being shown) includes a central block 60 of urethane or similar resilient material molded in one piece with a pair of steel end pieces 61, 62. A back plate 65 is bolted to end piece 61 and a front member 67 having a semicircular face 70 is bolted to end piece 62. This arrangement of urethane "sandwich" permits energy absorption by urethane block 60 and assists in preventing shearing of a retractable pin when it contacts one of the stop blocks.

Figure 6:
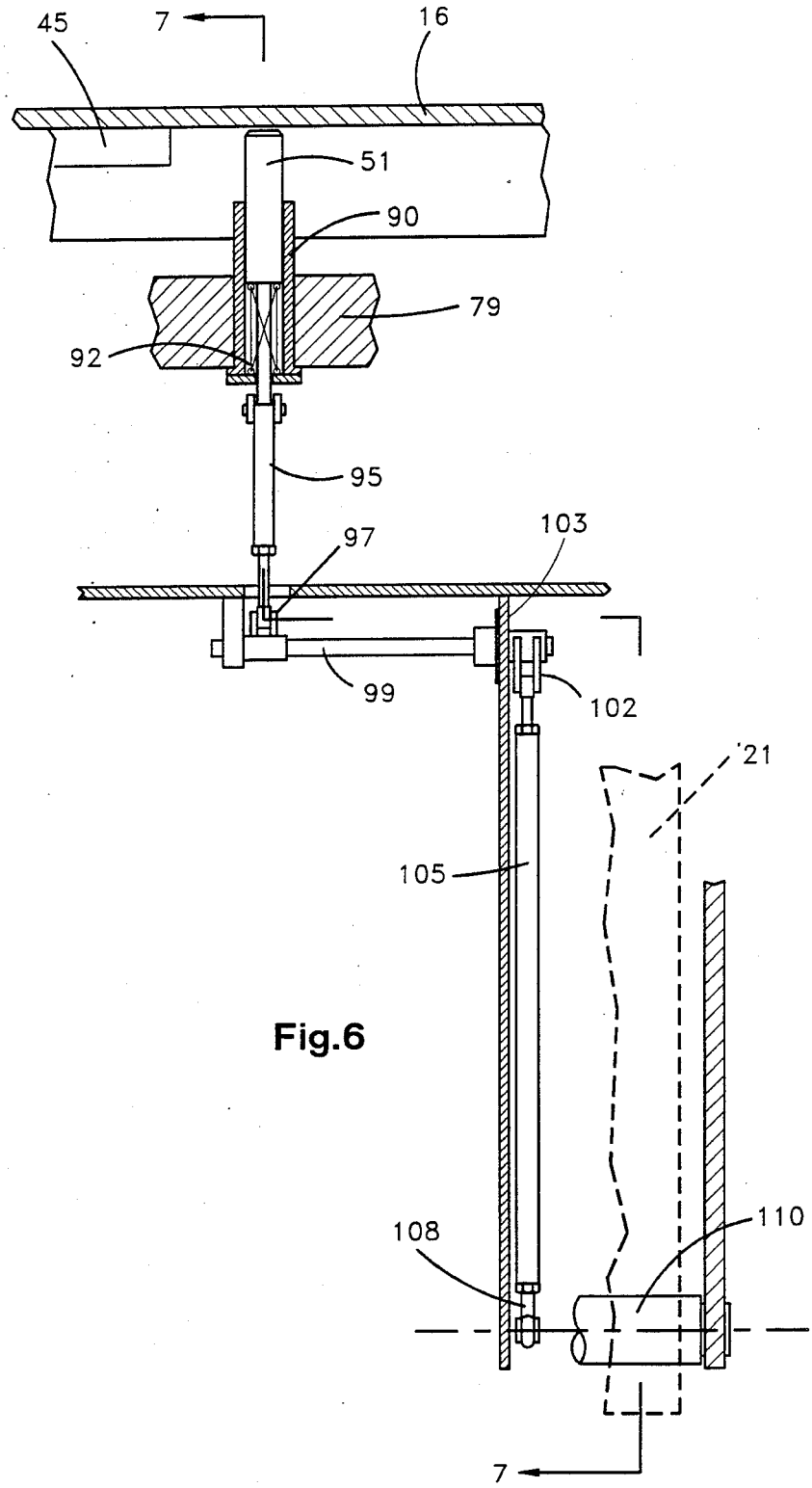
FIG. 6 is a sectional view on the line 6—6 of FIG. 4.

As shown in FIGS. 1, 7 and 8, rotatable base 16 is supported on the outer race 75 of a bearing 76. The inner race 77 of the bearing is supported by structural members 79, 80 of fire truck 10. The inner race 75 of the bearing is provided with teeth 82 which are driven by hydraulically operated gearing to rotate base 16 and position ladder 13. As shown in FIGS. 6 and 7, base 16 is prevented from rotating by contact between stop blocks 45, 46 and pins 50–53 when none of the outriggers are deployed. Each pin is retracted out of the path of the stop blocks, however, by deployment of its associated outrigger.

FIGS. 6–8 illustrate the mechanical connection between pin 51 and outrigger 21, the connections between the other pins and their associated outriggers being identical. Pin 51 is supported within cylindrical guide 90 which is mounted in the structural wall portion 79 of fire truck 10. A spring 92 is provided below pin 51 in guide 90 to bias the pin toward the extended position. Pin 51 is connected through a linkage 95 to a crank arm 97. An extension rod 99 connects crank arm 97 to a second crank arm 102 and is supported in a structural wall 103 of truck 10. Crank arm 102 is connected through rod 105 to another crank arm 108 which is connected to the pivotal support 110 for outrigger 21.

When outrigger 21 is in its normal retracted position crank arm 108 will be in its most clockwise rotational position as shown in FIG. 7. Crank arm 97 is then in its most counterclockwise position so that pin 51 is extended upwardly by the position of the crank arms and the bias provided by spring 92. In this position, the pin limits rotation of base 16. When outrigger 21 is deployed crank arm 108 is rotated counterclockwise to the position shown in FIG. 8. Crank arm 97 rotates clockwise and retracts pin 51 downwardly against the bias of spring 92 out of the path of stop block 45.

Figure 4:
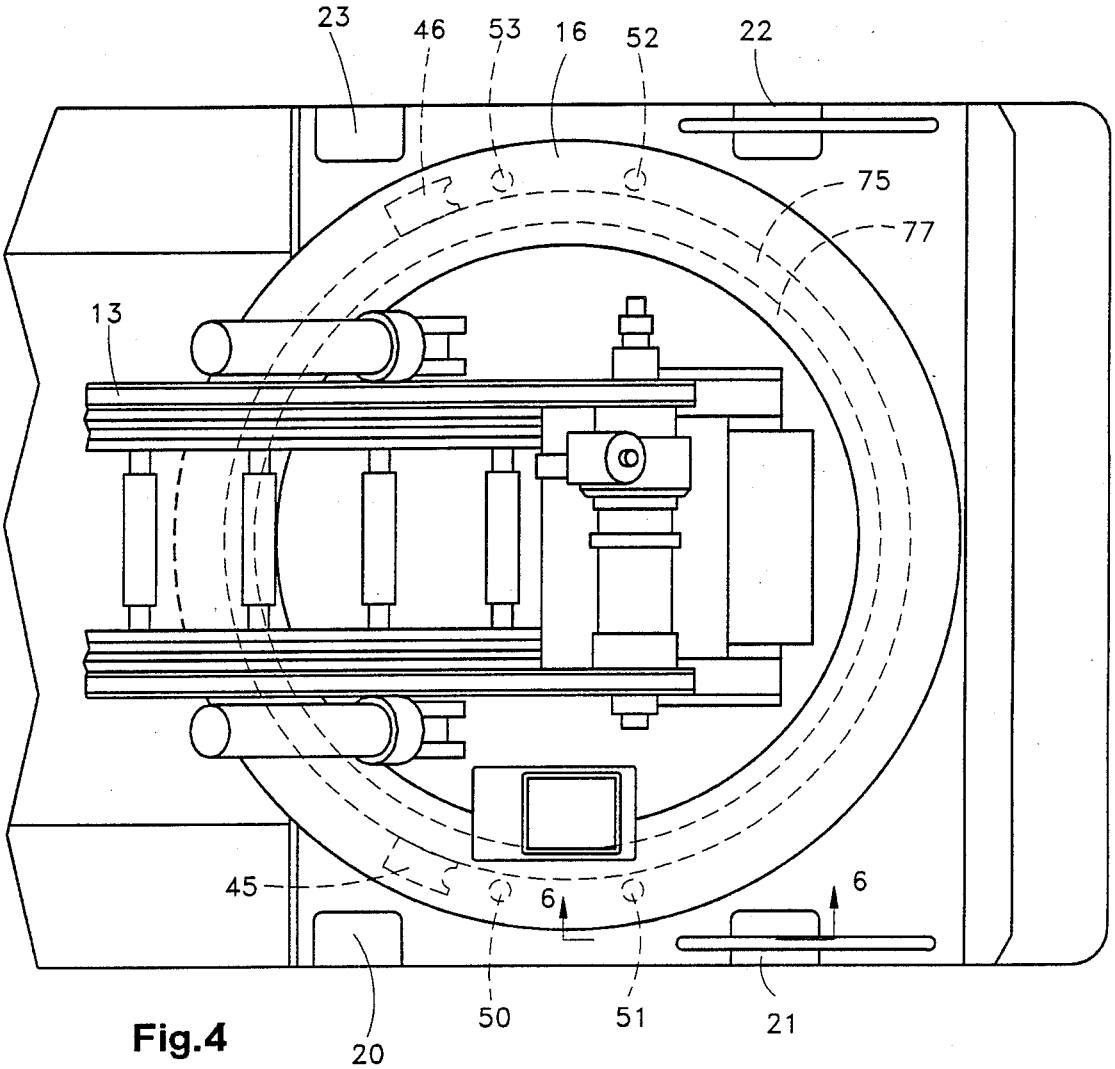
FIG. 4 is a top plan view of the rear portion of the vehicle.

Similar actions occur for each guide pin as its associated outrigger is deployed. Thus, as best seen in FIG. 4, if outriggers 20 and 21 are deployed pin 50 and 51 will be retracted. Base 16 can then be rotated counterclockwise through an approximate semicircle until stop block 45 contacts pin 52 on the opposite side of truck 10. Base 16 cannot be rotated in the clockwise direction, however, because of contact between stop block 46 and pin 53. Ladder 13, then, cannot be positioned over the side of the vehicle where outriggers 22 and 23 are not deployed. Similarly, when outriggers 22 and 23 instead of outriggers 20 and 21 are deployed, pins 52 and 53 will be retracted and clockwise, but not counterclockwise, rotation of base 16 will be permitted. In situations where all outriggers 20–23 are deployed, all the associated pins 20–23 will be retracted and base 16 can be rotated through a full circle to position ladder 13 at any desired point.

The interlock to limit rotation of base 16 according to deployment of the outriggers could be accomplished in many ways other than the mechanical linkage system as described herein, such as by electrical or hydraulic controls. A mechanical linkage system as described herein is preferred, however, because of its simplicity, reliability and direct action.

Figure 10:
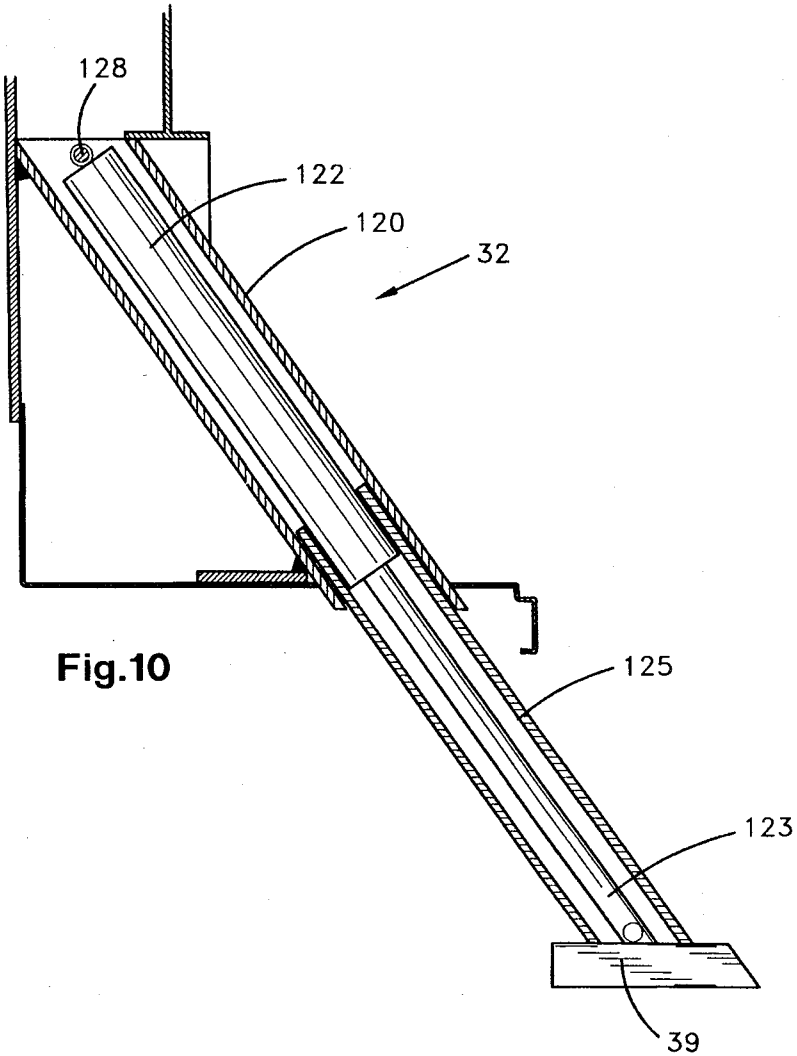
FIG. 10 is an elevational view of the auxilliary jack of FIG. 9 in the extended position.
Figure 9:
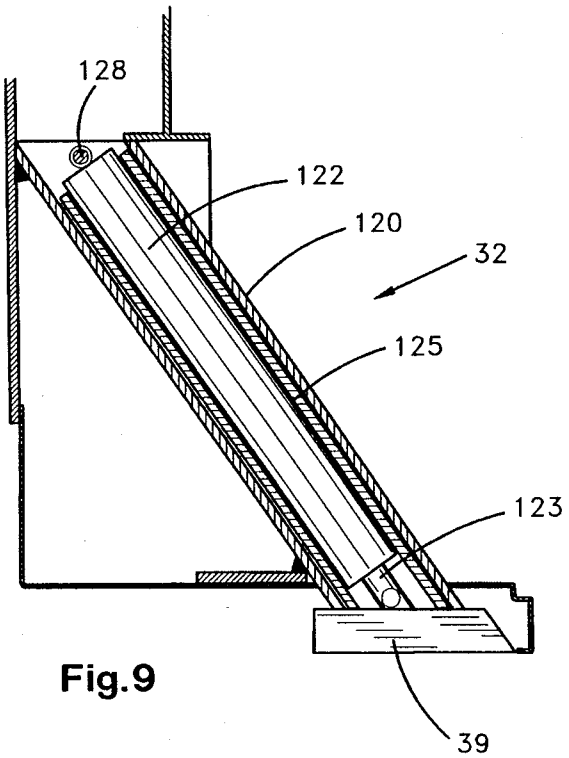
FIG. 9 is an elevational view of an auxilliary jack in the retracted position.

As mentioned above, a pair of auxilliary jacks sharing a common foot is mounted on each side of fire truck 10 between the outriggers. Auxilliary jacks 30, 31 with common foot 38 are shown retracted in FIG. 2 and jack 32 is shown deployed in FIG. 3. FIGS. 9 and 10 illustrate the structure of jack 32, the others being identical. As shown there, jack 32 includes a tubular housing 120 welded or otherwise suitably connected to the framework of fire truck 10. A hydraulically operated cylinder 122 and associated piston 123 are supported within frame 120. The free end of piston 123 is connected to foot 39. An extendable sleeve 125 is fitted between the periphery of cylinder 122 and the inner wall of housing 120 and is connected at its lower end to foot 39.

The two auxillary jacks on the same side of truck 10 operate in tandem. Hydraulic fluid is provided through a fitting 128 to the upper end of cylinder 122 and extends piston 123, while a corresponding action occurs for the companion jack. Foot 39 and sleeve 125 are moved to the extended position shown in FIG. 10. In this position, the auxilliary jacks do not significantly increase the width of truck 10 but provide stability against reaction forces developed when a high-pressure hose is used at the top of ladder 13.

Figure 11:
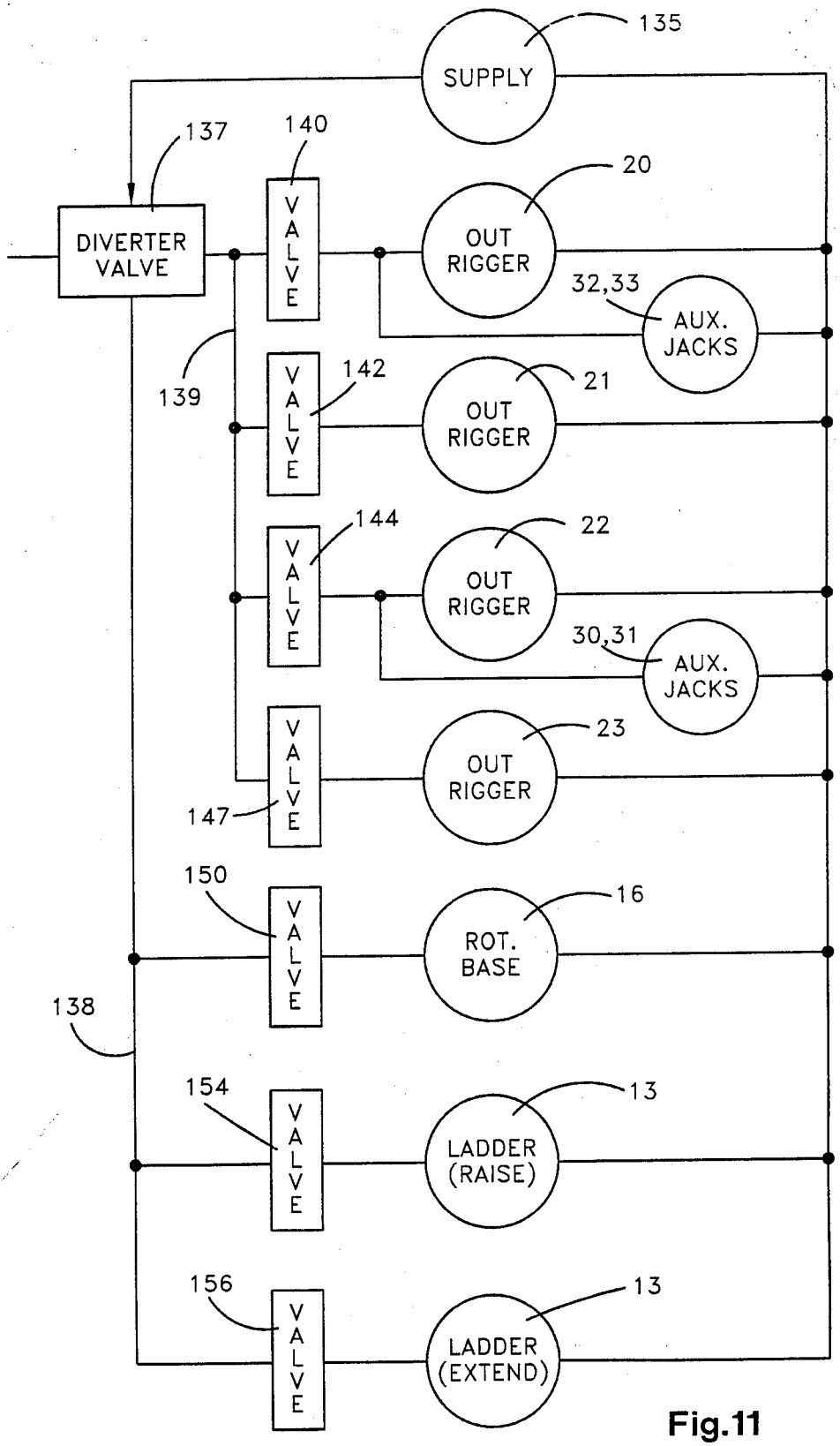
FIG. 11 is a simplified schematic of a hydraulic control circuit for the ladder and outriggers.

The ladder, outriggers and jacks described above are preferably hydraulically actuated. Operation of the system will be explained with reference to the hydraulic control circuit of FIG. 11. When fire truck 10 has arrived at the scene and been positioned as advantageously as possible, the outriggers on one or the other side of truck 10 must be deployed before ladder 13 can be employed. As shown in FIG. 11, a diverter valve 137 is first actuated to a position in which hydraulic fluid from a supply 135 is diverted entirely away from a ladder circuit 138 and directed to an outrigger circuit 139. This prevents ladder 13 from being raised or rotated with no outrigger deployed. The outriggers on the appropriate side of truck 10 are then deployed by actuating either valves 140 and 142 to deploy outriggers 20 and 21 or valves 144 and 147 to deploy outriggers 22 and 23. Actuation of, for example, valves 140 and 142 permits hydraulic fluid to be supplied to the cylinders of outriggers 20 and 21 to deploy the outriggers. Valve 140 also permits fluid to be supplied to extend auxilliary jacks 32, 33 on the opposite side of truck 10. Deployment of outriggers 20 and 21 causes pins 50 and 51 to be retracted by means of the linkages described above out of the path of stop blocks 45 and 46.

Diverter valve 137 is then again operated to direct hydraulic fluid from supply 135 away from outrigger circuit 139 and to ladder circuit 138. This prevents the outriggers from being retracted while ladder 13 is in use. Valve 154 can be actuated to raise ladder 13 and valve 156 to extend the ladder. Actuation of valve 150 causes rotatable base 16 to be rotated in the direction permitted by retraction of pins 50, 51. Ladder 13 can thus be positioned anywhere in the semicircular sector in which outriggers 20 and 21 are deployed.

When the need for ladder 13 ceases, it may be retracted by operating valve 156 in the opposite direction. The ladder can be rotated to a position parallel with truck 13 and lowered to its stored position by actuating valves 150 and 154. The deployed outriggers and auxilliary jacks can be retracted by first operating diverter valve 137 and then the valves associated with the deployed outriggers. Retraction of the outriggers places retracted pins 50 and 51 again in their extended position preventing rotation of base 16 and ladder 13.

What is claimed is:

1. Aerial apparatus comprising a platform, vertically extendible means mounted on said platform, said platform being rotatable to position said vertically extendible means for use at a desired circumferential location, stabilizing means extendible outwardly of said platform for stabilizing said vertically extendible means within a predetermined circumferential sector, and means responsive to extension of said stabilizing means for permitting said vertically extendible means to be positioned only within said predetermined circumferential sector.

2. Aerial apparatus as claimed in claim 1 including a vehicle supporting said platform.

3. Aerial apparatus as claimed in claim 1 including mechanical stop means in the rotational path of said platform, and wherein said means responsive to extension of the stabilizing means removes said stop means from the path of said platform to permit said platform to rotate within said predetermined circumferential sector.

4. Aerial apparatus as claimed in claim 3 including a resilient member for cushioning the impact between said platform and said stop means.

5. Aerial apparatus as claimed in claim 1 wherein said means responsive to extension of said stabilizing means includes a retractable pin positioned in the rotational path of said platform, and means connected between said stabilizing means and said pin for retracting said pin out of said path in response to extension of said stabilizing means.

6. Aerial apparatus as claimed in claim 5 including a stop block connected to said platform and engagable with said retractable pin.

7. Aerial apparatus as claimed in claim 6 wherein said stop block includes a resilient member for cushioning the impact between said stop block and said retractable pin.

8. Aerial apparatus as claimed in claim 1 including second stabilizing means for stabilizing said vertically extendible means within a second predetermined circular sector, and means responsive to extension of said second stabilizing means for permitting said vertically extendible means to be positioned only within said second predetermined sector.

9. Aerial apparatus as claimed in claim 1 including auxillary stabilizing means extended on the opposite side of said platform from said stabilizing means in response to extension of said stabilizing means.

10. Aerial apparatus comprising a platform, vertically extendible means mounted on said platform, said platform being rotatable to position said vertically extendible means at a desired circumferential location, first and second stabilizer means extendible outwardly of said platform for stabilizing said vertically extendible means within first and second predetermined circumferential sectors, respectively, and means responsive to extension of one of said stabilizer means for permitting said vertically extendible means to be positioned only within the circumferential sector stabilized by the extended stabilizer means.

11. Aerial apparatus as claimed in claim 10 wherein said means for permitting positioning of the vertically extendible means includes first and second mechanical means positioned to prevent rotation of said platform, and means responsive to extension of one of said stabilizer means for moving the corresponding mechanical means out of the path of said platform to permit positioning of said vertically extendible means within the circumferential sector stabilized by the extended stabilizer means.

12. Aerial apparatus as claimed in claim 11 wherein each said mechanical means includes a retractable pin in the rotational path of said platform, and wherein said means responsive to extension of one of the stabilizer means includes a mechanical linkage between the stabilizer means and retractable pin for retracting the pin in response to extension of the stabilizer means.

13. Aerial apparatus as claimed in claim 12 including first and second stop blocks connected to said platform and engagable with said retractable pins.

14. Aerial apparatus as claimed in claim 13 wherein each said stop block includes a resilient member for cushioning impact between the stop block and the retractable pin.

15. Aerial apparatus as claimed in claim 10 including first and second auxilliary stabilizer means positioned opposite respective first and second stabilizer means and extendable in response to extension of the respective stabilizer means.

16. Aerial ladder apparatus comprising a platform, an aerial ladder mounted on said platform, said platform being rotatable to position said ladder at desired circumferential locations, first and second stabilizers extendible outwardly of said platform for stabilizing said ladder within first and second predetermined circumferential sectors, respectively, first and second retractable pins in the rotational path of said platform, and mechanical linkage means between each of said stabilizer means and the corresponding retractable pin for retracting said pin in response to extension of the corresponding stabilizer means, whereby said ladder may be positioned only within the circumferential sector stabilized by the extended stabilizer means.

17. Aerial apparatus as claimed in claim 16 including a vehicle supporting said platform.

* * * * *